US006938831B1

(12) United States Patent
Brown

(10) Patent No.: US 6,938,831 B1
(45) Date of Patent: Sep. 6, 2005

(54) HELMET AND HEADWEAR MISTING SYSTEM

(76) Inventor: Gary Brown, 1055 E. Hyde Park B1, Inglewood, CA (US) 90302

( * ) Notice: Subject to any disclaimer, the term of this patent is extended or adjusted under 35 U.S.C. 154(b) by 148 days.

(21) Appl. No.: 10/601,488

(22) Filed: Jun. 23, 2003

(51) Int. Cl.[7] ..... A24F 25/00; R05B 3/00; A62B 18/00

(52) U.S. Cl. ..... 239/34; 239/726; 239/270; 239/274; 239/311; 239/338

(58) Field of Search ..... 239/34, 726, 270, 239/274, 302, 311, 338, 337, 353, 373

(56) References Cited

U.S. PATENT DOCUMENTS 5,193,347 A * 3/1993 Apisdorf ..... 62/3.7
5,261,399 A * 11/1993 Klatz et al. ..... 607/104
5,353,605 A * 10/1994 Naaman ..... 62/259.3
6,050,099 A * 4/2000 Lopa et al. ..... 62/259.3
6,427,467 B1 * 8/2002 Bell ..... 62/259.3

* cited by examiner

*Primary Examiner*—Davis Hwu
(74) *Attorney, Agent, or Firm*—Goldstein Law Offices, P.C.

(57) ABSTRACT

A spray misting system for use with headwear having a front and rear, including an integrated reservoir and pump which contains a quantity of water, and a forward misting nozzle. The forward misting head is provided at the front of the headwear forwardly of the user to direct a fine, cooling, spray mist toward the user. A conduit connects the water reservoir with the forward misting nozzle, and a flow control valve allows the user to control the flow of water through the conduit. When desired the user operates a handle on the integrated reservoir and pump to initiate flow through the conduit to create a misting spray at the forward misting head which is directed toward the face and forehead of the user to effect cooling of the user.

7 Claims, 8 Drawing Sheets

HELMET AND HEADWEAR MISTING SYSTEM

BACKGROUND OF THE INVENTION

The invention relates to a helmet misting system. More particularly, the invention relates to a system, which is mounted in a helmet or other headwear, to provide a cooling, misting spray when desired by the wearer.

When engaged in rigorous activities, such as biking, there is a significant tendency for overheating. Such a tendency is exacerbated in conditions of intense sun, high ambient temperatures, and high humidity. These conditions not only make such a person feel the sensation of being uncomfortably hot, but can actually increase his/her body temperature to a dangerous level. As a result, it is highly advisable to drink water to aid the body with its natural cooling ability. At times, however, the body's ability to regulate temperature internally is compromised by both the extent of activity, and rising ambient temperatures. Accordingly, it is often desirable to provide external cooling to the body. Since a large amount of the body's heat is expelled through the head, such is a natural and advisable target for external cooling.

The common practice of "splashing water on one's face" can be very effective to quickly "cool down". Doing so, however, can be dangerous as it can actually send the body into shock in extreme conditions. Further, frequently it will result in a waste of water and wetting one's clothes. Still further, it is not convenient to do so while engaged in vigorous activity—such as biking.

While available units may be suitable for the particular purpose employed, or for general use, they would not be as suitable for the purposes of the present invention as disclosed hereafter.

SUMMARY OF THE INVENTION

It is an object of the invention to provide a system for allowing a person to quickly and effectively cool down. Accordingly, the present invention provides a refreshing spray mist to the head, which aids the body in dissipating heat.

It is another object of the invention to provide a system, which allows a person to cool down while engaged in a vigorous activity. Accordingly, the invention employs misting nozzles, mounted in headgear such as a helmet or baseball cap, which are oriented toward the head. The wearer is allowed to control the misting produced by said nozzles by use of an integrated water supply and hand pump.

It is yet another object to provide a system, which can be used in existing headwear. Accordingly, the invention may be provided in a harness which positions the misting nozzles and associated plumbing at appropriate locations with respect to the head, and is mountable within existing headwear of various types.

It is yet a further object to provide a system, which imparts cooling to the front and rear of the head. Accordingly, embodiments of the system employ misting nozzles mounted both anteriorly and posteriorly so as to provide a cooling mist to the forehead and face, as well as the back of the neck.

It is a still further object of the invention to provide a system, which can be used to satisfy the thirst and replace fluids needed for natural cooling. Accordingly, a drinking nozzle may be provided in conjunction with the headwear, conveniently located to allow the wearer to drink fluids therefrom.

The invention is a spray misting system for use with headwear having a front and rear, including an integrated reservoir and pump, which contains a quantity of water, and a forward misting head. A forward misting nozzle is provided at the front of the headwear forwardly of the user to direct a fine, cooling, spray mist toward the user. A conduit connects the water reservoir with the forward misting head, and a flow control valve allows the user to control flow through the conduit. When desired the user operates a handle on the integrated reservoir and pump to initiate flow through the conduit to create a misting spray at the forward misting head which is directed toward the face and forehead of the user to effect cooling of the user.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
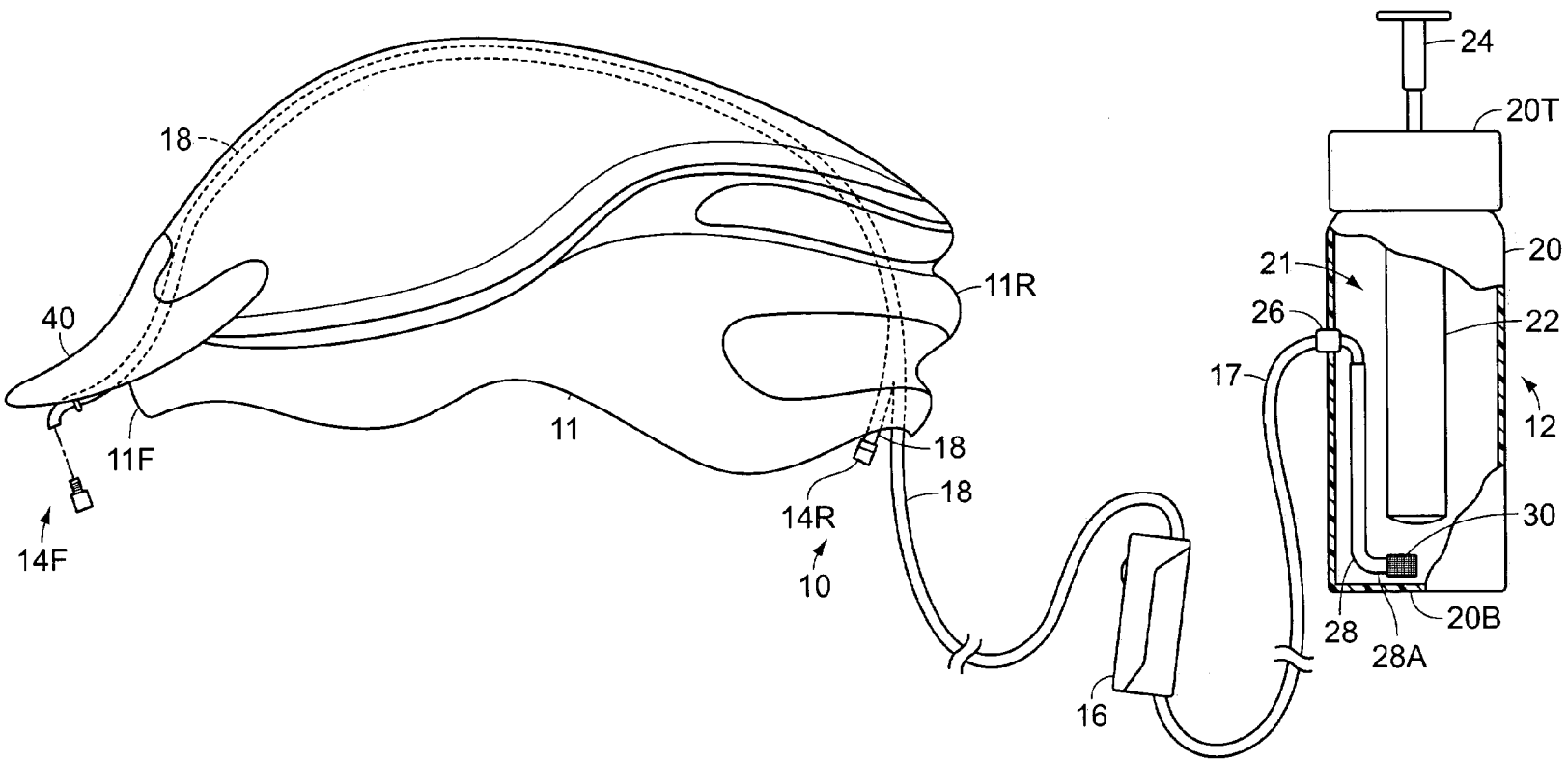
FIG. 1 is a side elevational view of the invention, illustrating the major components of the invention installed within headwear, which is illustrated as a biking helmet.

FIG. 1 illustrates a headwear misting system 10, incorporated within headwear 11, which has an interior cavity that is sized and configured to fit upon a human head. The misting system 10 comprises an integrated reservoir and pump 12, misting nozzles 14, a flow control valve 16, and conduits including a primary conduit 17 connecting the integrated reservoir and pump 12 with the flow control valve 16, and misting conduits 18 connecting the flow control valve 16 with the misting nozzles 14.

The integrated reservoir and pump 12 comprises a container 20 having a bottom 20B, a top 20T, and a container interior 21 capable of holding a volume of water, and a water pump 22. The water pump 22 is actuable by a handle 24, extending outside of the reservoir and pump 12 above the top 20T of the container. The water pump 22 generally pressurizes the interior 21 of the container 20 to cause water therein to flow out through an output port 26. More particularly, a collecting tube 28 is attached to the output port 26 at one end, and has an open end 28A at an opposite end thereof. The open end 28A has a tubular filter screen 30, which prevents particulate matter that might be present in the water from entering the collecting tube 28. The open end 28A is positioned near the bottom 20B of the container to facilitate collection of water even when the container is nearly empty.

Figure 3:
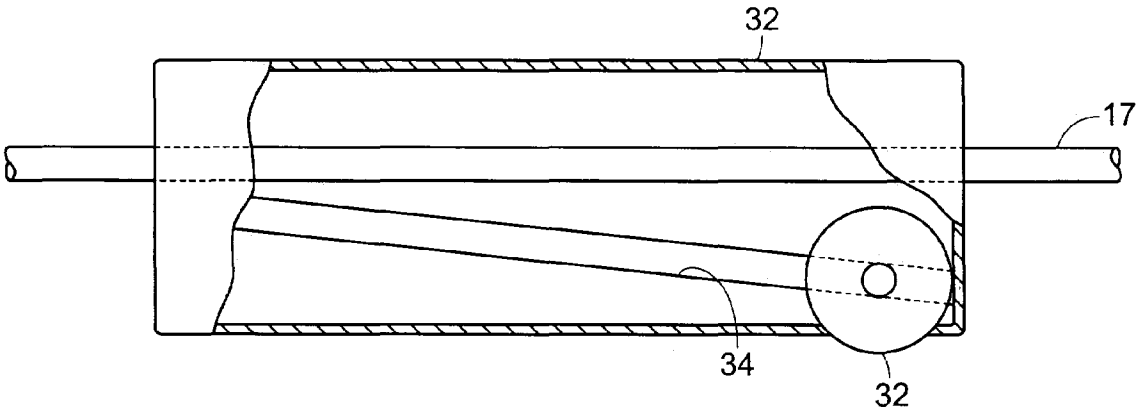
FIG. 3 is a side elevational view, with parts broken away, illustrating a flow control valve according to the present invention.

The primary conduit 17 connects the output port 26 with the flow control valve 16. Referring momentarily to FIG. 3, the flow control valve 16 has a housing 32 through which the primary conduit 17 extends in a linear fashion. The flow control valve 16 may be configured with a thumbwheel 32 mounted for movement along an inclined track 34, such that the thumbwheel 32 is movable along the track 34 by the user to selectively allow unobstructed flow through the primary conduit 17 in the position shown; and to selectively pinch the primary conduit 17 in varying degrees by moving the thumbwheel 32 up the track 34 toward and against the primary conduit 17 so as to reduce flow through the primary conduit 17—thereby allowing a user to control flow through said primary conduit 17.

Referring again to FIG. 1, the headgear 11 has a front 11F and a rear 11R. Accordingly the misting nozzles 14 include a front misting nozzle 14F and a rear misting nozzle 14R, which are attached to the flow control valve 16 by the misting conduits 18. The front misting nozzle 14F is located near the headgear front 11F, and the rear misting nozzle 14R is located near the headgear rear 11R. More particularly, the head gear 11F has a forward protrusion 40 which extends forwardly of the user when wearing the head gear 11F, and the front misting nozzle 14F is located beneath the forward protrusion 40 so as to position the front misting nozzle 14F significantly in front of the user.

Figure 4:
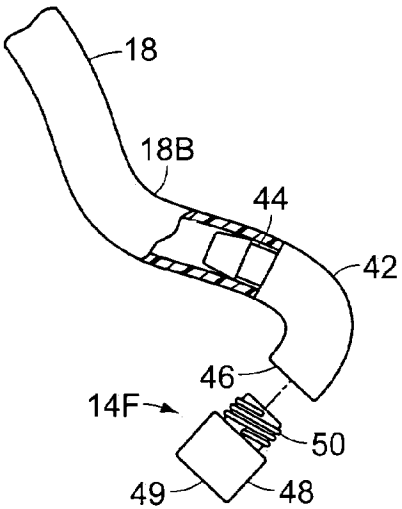
FIG. 4 is a side elevational view with parts broken away, illustrating the forward misting nozzle, and its interconnection with one of the misting conduits.

Referring now to FIG. 4, the front misting nozzle 14F is attached to its associated misting conduit 18 with an elbow 42, having a plug 44, and a receptacle end 46 opposite therefrom. In general, the misting nozzles 14 include a removable misting head 48. The removable misting heads 48 have a spray surface 49 for creating a fine spraying mist and have a threaded portion 50. The spray surface 49 only allows a small quantity of water to flow therethrough—preferably no more than one half gallon per hour. The threaded portion 50 is removably attachable in the receptacle end 46, so as to allow the misting heads 48 to be removed for cleaning, yet remain securely in place during use. The misting conduit 18 associated with the front misting nozzle 14F has a front misting conduit bend 18B which deflects the conduit so as to allow the misting conduit to extend nearly horizontally adjacent to the elbow 42. A non-rusting metal coil may be contained within the misting conduit near the bend so as to prevent kinking of the tube thereat and help maintain the bend 18B. In addition, the elbow 42 preferably has a substantially seventy-degree bend so as to orient the front misting head 14F downwardly and inwardly toward the user.

Referring again to FIG. 1, the rear misting head 14R is oriented generally downward and inward by virtue of its associated misting tube 18. In particular, the rear misting head 14R is oriented so as to direct its spraying mist toward the back of the user's neck when wearing the headwear 11.

In general then, the user operates the handle 24 of the integrated reservoir and pump 12 to generate pressurized flow of water therefrom out the output port, through the primary conduit 17, and into the misting conduits 18 under the selective attenuation of the flow control valve 16. The front and rear misting nozzles 14F, 14R generate a fine spraying mist which is directed at the user wearing the headwear, and more particularly, at his/her forehead and face, and his/her neck, respectively.

Figure 2:
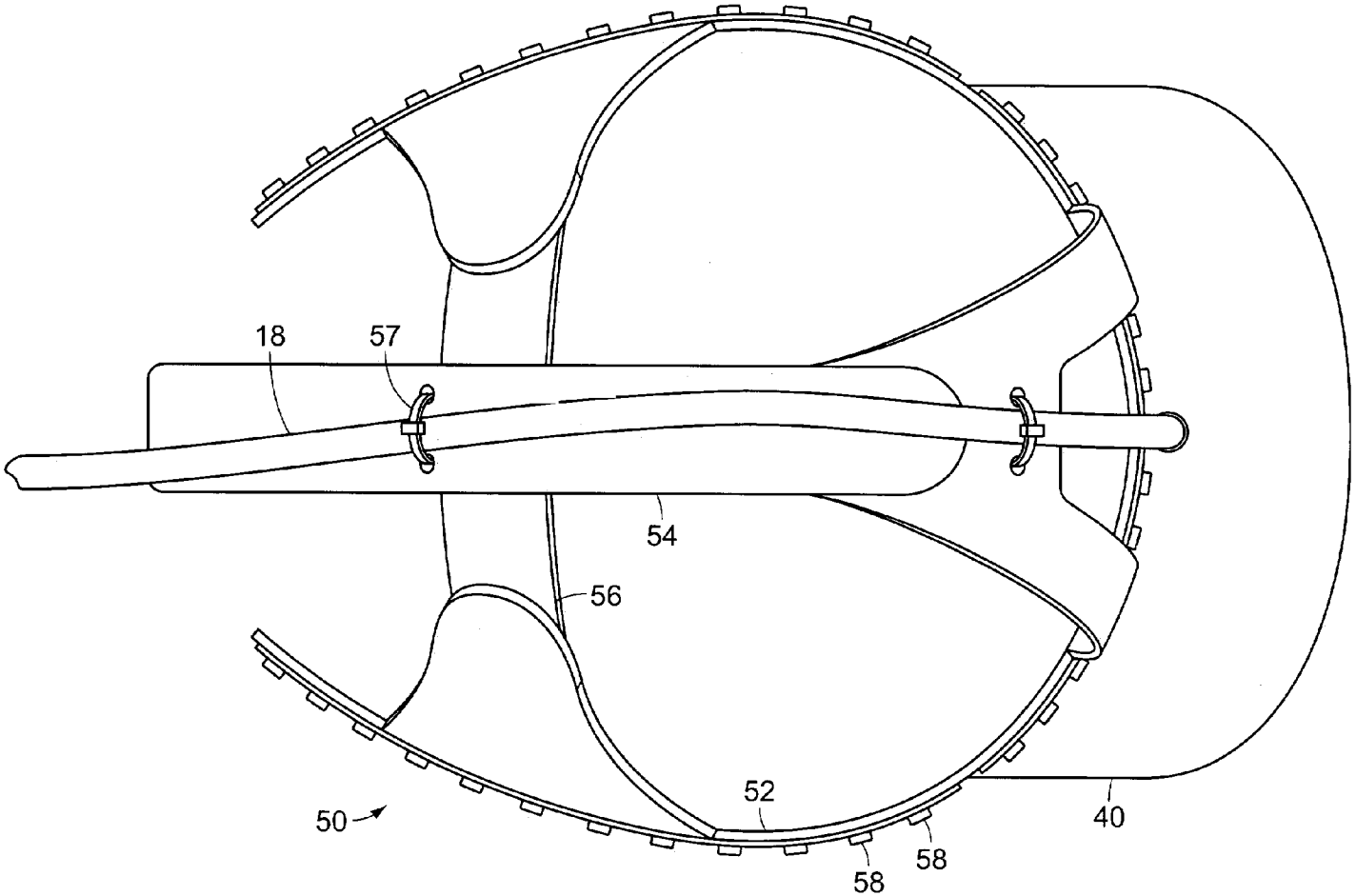
FIG. 2 is a top plan view of an embodiment of the invention, wherein the invention is embodied within a harness that is installable into user selectable headwear.

Referring now to FIG. 2, to facilitate the use of various headwear as selected by the user and perhaps already manufactured, the misting conduits 18 and misting heads 14 may be embodied in a harness 50 which is itself intended to fit within the headwear. The harness 50 is sized to fit over the human head, and has an exterior horizontal outer band 52 which is sized and shaped to fit within headwear, which would otherwise directly accommodate the human head. Accordingly, during use, the harness 50 is intended to be interposed between the head of the user, and the headwear being worn by the user. The outer band 52 extends generally horizontally around the human head, with the forward protrusion 40 attached to the outer band 52, and is discontinuous rearwardly, opposite from the forward protrusion 40. A longitudinal upper band 54 extends at an arc from the outer band 52 at the protrusion 40 for extending rearwardly over the human head, and a transverse upper band 56 extends from the outer band 52, meets and is attached to the longitudinal upper band 54. The transverse upper band 56 extends from the outer band 52 substantially midway rearwardly from the protrusion 40. To facilitate stability of the harness 50, thee transverse upper band 56 is preferably flared outward downwardly toward the outer band 52. One of the misting conduits 18 extends forwardly over the longitudinal upper band 54, attached thereto by periodic clips 57, and extends fully to the protrusion 40.

Figure 5:
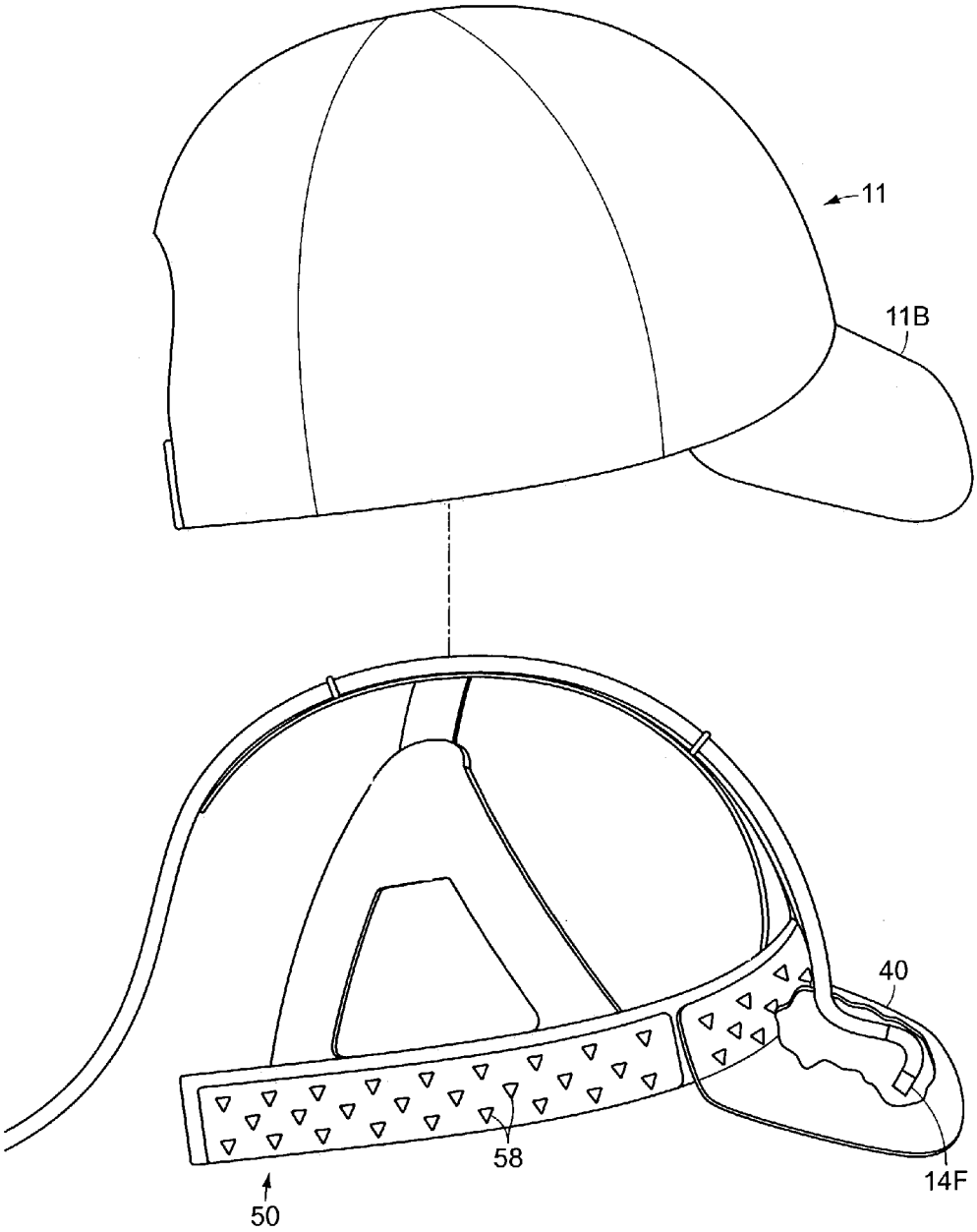
FIG. 5 illustrates the harness illustrated in FIG. 2 being installed into a baseball cap.

Referring now to FIG. 5, a plurality of downwardly extending hooks 58 are preferably mounted outwardly on the outer band 52 so as to catch interior surfaces of the headwear to secure the harness 50 therein without the necessity of having mating fastener material within the headwear. Accordingly, as illustrated in FIG. 5, the harness 50 is being installed within the headwear 11, which is illustrated as being a baseball cap, having a bill 11B. The protrusion 40 extends directly beneath and mounts upwardly against the bill 11B. The forward misting nozzle 14F is therefore mounted beneath the bill 11B.

Figure 6:
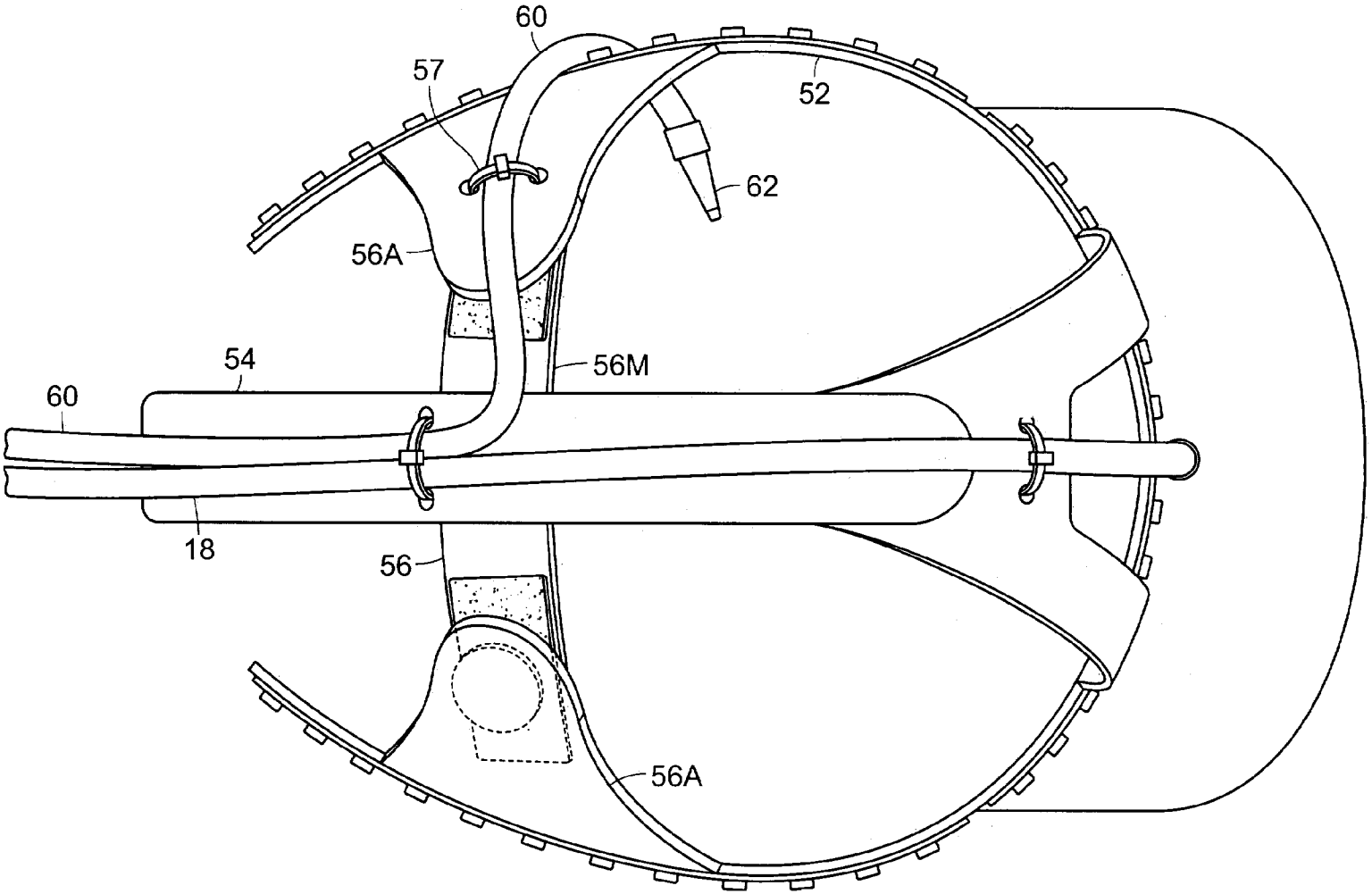
FIG. 6 is a top plan view of an embodiment of the invention, illustrating misting and drinking conduits installed within the harness, and further illustrating the adjustability of the harness and the positioning of the drinking nozzle.

Referring to FIG. 6, to help the harness 50 fit within the headwear 11, the harness is adjustable by dividing the transverse upper band 56 into two outer transverse bands 56A which are attached to the outer band 52, and an intermediate transverse band 56M which is attached to the longitudinal upper band 54. Fastener material 58 is attached to each of the outer transverse bands 56A and to the intermediate transverse band 56M to allow the transverse band 56 to be effectively shortened and lengthened to adjust the harness so that it fits the user, and fills the headwear to meets its outer perimeter.

Also illustrated in FIG. 6, a drinking conduit 60 is provided, and terminates in a drinking nozzle 62. The drinking nozzle 62 is preferably provided alongside the user so as to not interfere with the vision of the user. Accordingly, the drinking conduit 60 extends forwardly along the longitudinal upper band 54 alongside the misting conduit 18 extending toward the forward misting head, but deviates at a substantially right angle to extend toward and beyond the outer band 52 by extending along the transverse band 56, and then extending below the outer band 52 to the drinking nozzle 62. In particular, both the drinking conduit 60 and said misting conduit 18 is firmly mounted to the longitudinal band 54 by one of the clips 57, while the drinking conduit 60 is mounted to one of the outer transverse bands 56A with another one of the clips 57.

Figure 7:
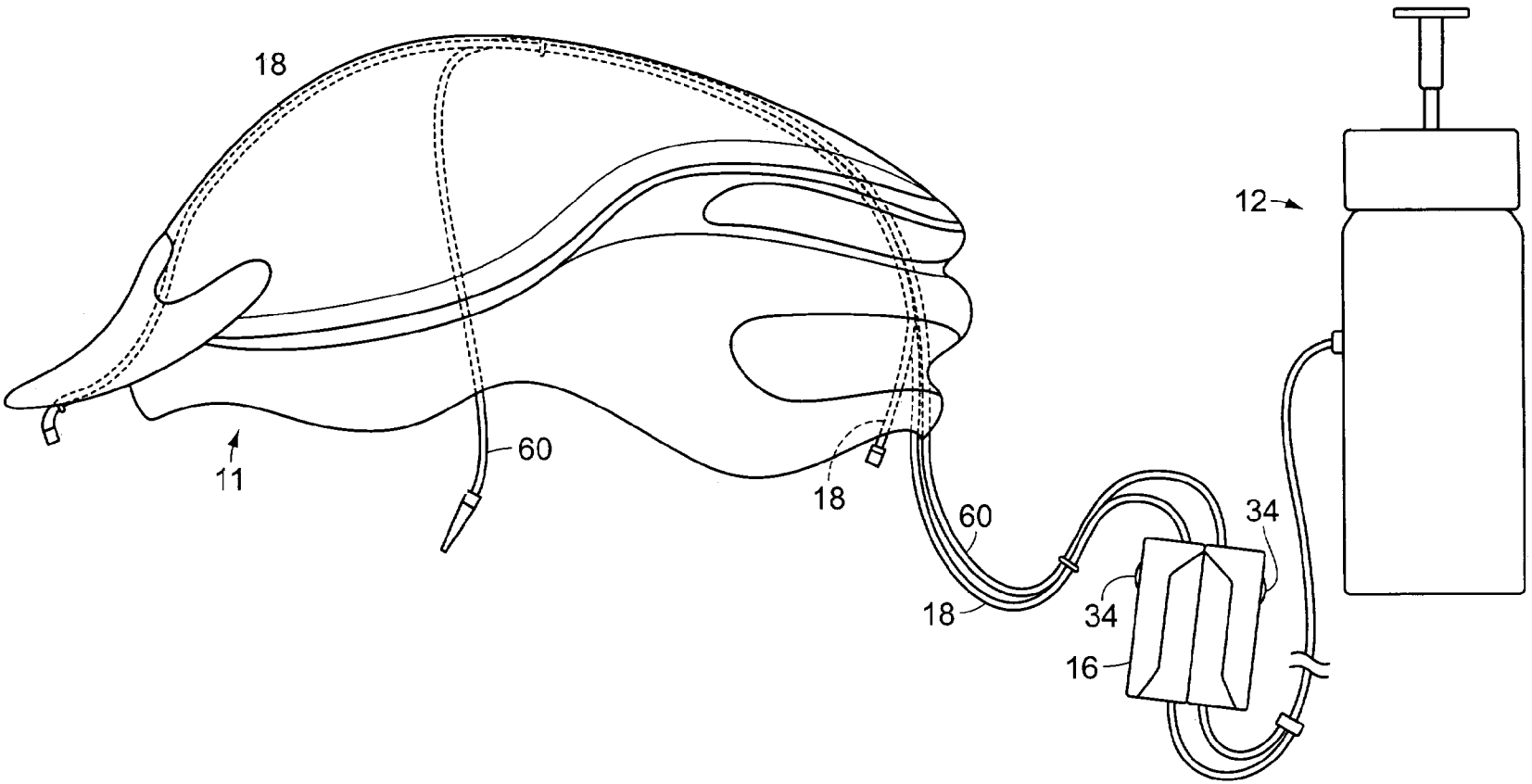
FIG. 7 is a side elevational view of an embodiment of the invention, similar to FIG. 1, except having the drinking nozzle and associated drinking conduit and flow control valve.
Figure 8:
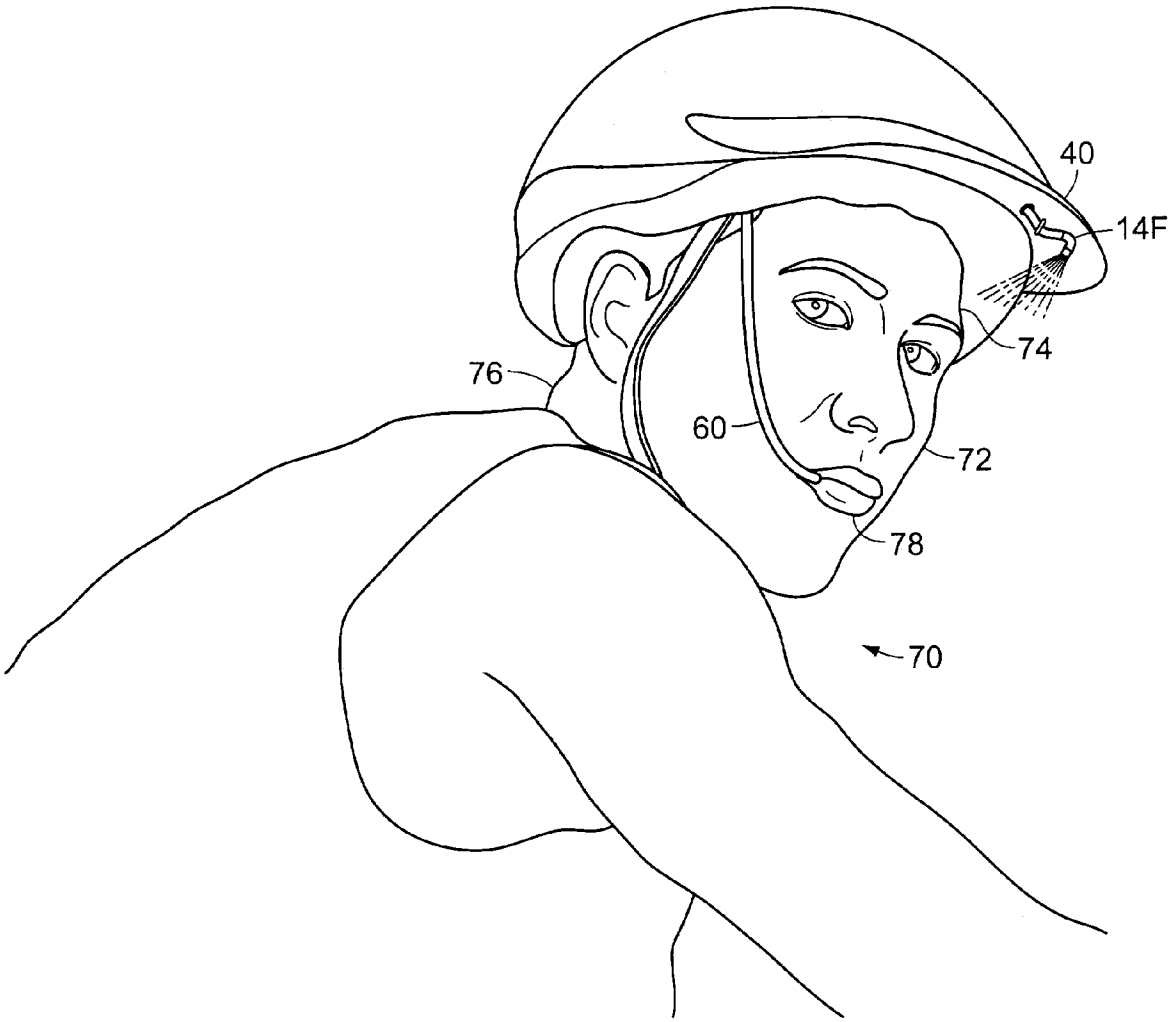
FIG. 8 is a diagrammatic perspective view, illustrating the embodiment of the invention incorporated within the biking helmet, in use by a biker/user, supplying a misting spray to the helmet wearer.

FIG. 7 illustrates an embodiment of the invention, similar to FIG. 6, wherein the headwear 11 is a helmet, and wherein the drinking nozzle is provided and descends therefrom. To allow separate flow control to the drinking nozzle 60, and to the front and rear misting nozzles 14F, 14R while they all derive water flow from the integrated reservoir and pump 12, the control valve 16 employs two thumbwheels 34 to allow separate control of flow within the misting and drinking conduits 18, 60. FIG. 8 illustrates this embodiment in use on a user 70 having a face 72, forehead 74, neck back 76 and mouth 78, wherein the forward misting nozzle 14F is suitably mounted on the forward protrusion 40 to direct a fine misting spray rearwardly and downwardly toward the face 72 and forehead 74 of the user 70. In addition, the rear misting nozzle 14R (not shown) being oriented generally downwardly, directs a fine misting spray toward the neck back 76 of the user. Further, the drinking conduit 60 extends downward from the headwear 11 and conveniently positions the drinking nozzle within the user's mouth 76 so that the user 70 can drink therefrom.

Figure 9:
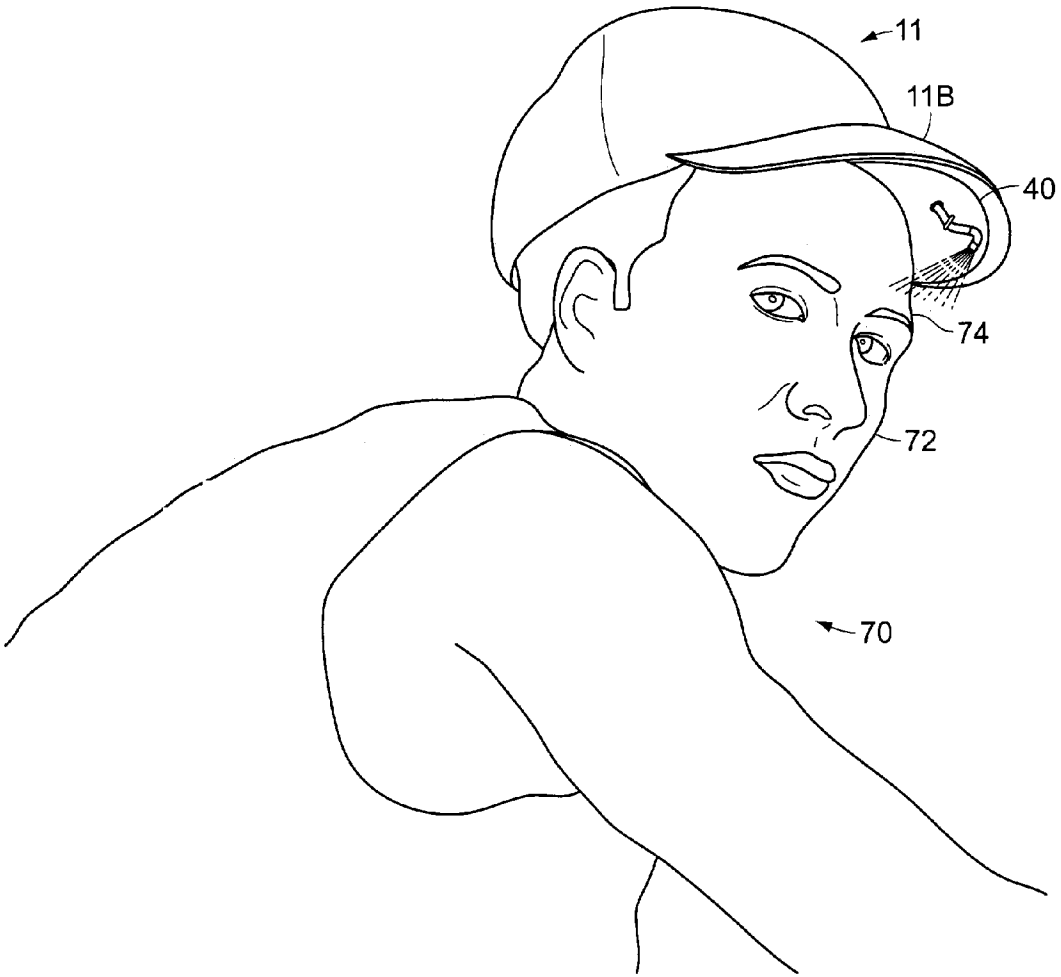
FIG. 9 is a diagrammatic perspective view of the invention in use, similar to FIG. 8, except illustrating the harness installed in a baseball cap.

FIG. 9 illustrates the harness embodiment of the invention installed within user chosen headwear 11, herein illustrated in the form of a baseball cap. In particular, the harness is mounted inside the cap, with the protrusion 40 extending forwardly beneath the bill 11B. The forward spray nozzle 14F is similarly directing a fine misting spray to the forehead 74 and face 72 of the user 70. Aside from the illustrates of FIG. 8 and FIG. 9, the invention may be contained in any type of user selected headwear by installing the harness up into the headwear and inserting the user's head into the harness.

In conclusion, herein is presented a headwear misting system which may be installed in a variety of headwear, effectively cools a person through the use of one or more fine misting sprays, and may allow them to replace internal cooling and regulatory fluids by providing a drinking nozzle. The invention is illustrated by example in the drawing figures, and throughout the written description. It should be understood that numerous variations are possible, while adhering to the inventive concept. Such variations are contemplated as being a part of the present invention.

What is claimed is:

1. A misting system, for cooling a user having a head, the headwear having a cavity for receiving the head of the user, a front, and a rear, comprising:

an integrated water supply and pump, including a container for holding a quantity of water, an output port, and a handle for pressurizing the container and initiating water flow out the output port;

a front misting nozzle, mountable to the headwear near the front, the front misting nozzle having a spray surface for creating a fine spray of water, the nozzles oriented generally rearwardly toward the user when the user is wearing the headwear;

at least one misting conduit for communicating water from the output port of the integrated water supply and pump to the front misting nozzle, so that when the user wears the headwear, the front misting nozzle is mounted in place thereon, and the user operates the handle, a misting spray is directed from the front misting nozzle toward the user;

a rear misting nozzle in communication with the at least one misting conduit and mountable in the headwear near the rear so that the rear misting nozzle is oriented generally downwardly toward a neck back of the user so that when the handle is operated a misting spray is directed toward the neck of the user;

a drinking nozzle which attaches within the headwear so that it extends downwardly from the headwear to allow the user to drink therefrom;

a drinking conduit connecting the output port to the drinking nozzle;

a flow control valve, interposed between the misting nozzles and the output port, for allowing the user to control flow through the misting conduit to the misting nozzles, and for separately controlling flow through the drinking conduit.

2. The misting system as recited in claim 1, further comprising a harness which is sized and shaped to fit within the article of headwear and itself is sized to accept a human head therein, the harness has an outer horizontal band, a forward projection where the front misting nozzle is located, a longitudinal band attached to the horizontal band near the forward projection and extending rearwardly therefrom, and a transverse band attaching the horizontal band to the longitudinal band, the misting conduit associated with the forward misting head extends forwardly on the longitudinal band to the forward portion where it meets the front misting nozzle, the harness further has a mechanism for attaching the harness into the headwear.

3. The misting system as recited in claim 2, wherein the misting conduit associated with the forward misting head has a bend near the forward misting nozzle for allowing the misting conduit to extend substantially horizontally forward on the forward projection, the forward misting nozzle has a removable misting head which is selectively connected to said misting conduit with an elbow and removable for cleaning, the elbow having a plug at one end for connection to the misting conduit, and a receptacle for allowing the forward misting nozzle to be removably attached therein, the elbow is bent to position the removable misting head to direct the misting spray therefrom so that it orients the misting head of the forward misting nozzle rearwardly and downwardly toward the user when wearing the headwear.

4. The misting conduit system as recited in claim 3, wherein the transverse band further comprises a pair of outer transverse bands attached to the horizontal outer band, and an intermediate transverse band, the outer transverse bands are selectively mateable to the intermediate transverse band with fastener material at various positions to adjust the harness to different sized heads.

5. The misting conduit system as recited in claim 4, wherein the outer band has a plurality of downwardly extending hooks, for allowing the harness to catch an interior surface of the headwear and fasten therein.

6. The misting conduit system as recited in claim 5, wherein the drinking conduit extends forwardly along and is attached to the longitudinal band and then extends downwardly along and is attached to one of the outer transverse bands before extending below the outer horizontal band toward the drinking nozzle.

7. The misting conduit system as recited in claim 6, wherein each removable misting head has a threaded portion opposite from the spray surface to facilitate selective removal of the misting head to allow for the cleaning of its spray surface.

* * * * *